US006070964A

United States Patent [19]

Sumiya

[11] Patent Number: 6,070,964

[45] **Date of Patent: *Jun. 6, 2000**

[54] MULTICOLOR PRINTING DEVICE

[75] Inventor: Hiroshi Sumiya, Nagoya, Japan

[73] Assignee: Brother Kogyo Kabushiki Kaisha, Nagoya, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/574,926

[22] Filed: Dec. 19, 1995

[30] Foreign Application Priority Data

Jan. 18, 1995 [JP] Japan ..... 7-24750

[51] Int. Cl.[7] ..... B41J 2/21; B41J 29/293; B41J 29/38; B41J 2/195

[52] U.S. Cl. ..... 347/43; 347/19; 347/14; 347/7

[58] Field of Search ..... 347/43, 7, 85, 347/14, 30, 19; 358/502

[56] References Cited

U.S. PATENT DOCUMENTS

| | | | |
|---|---|---|---|
| 4,833,491 | 5/1989 | Rezanka | 347/15 |
| 5,057,852 | 10/1991 | Formica et al. | 347/43 |
| 5,315,317 | 5/1994 | Terasawa et al. | 347/7 |
| 5,355,159 | 10/1994 | Kaneko | 347/3 |
| 5,367,328 | 11/1994 | Erickson | 347/7 |
| 5,581,284 | 12/1996 | Hermanson | 347/43 |
| 5,587,730 | 12/1996 | Karz | 347/43 |
| 5,646,656 | 7/1997 | Leonhardt et al. | 347/43 |

FOREIGN PATENT DOCUMENTS 3-142249 6/1991 Japan .

OTHER PUBLICATIONS

English–language abstract of Japanese Laid–open Patent Publication No. 3–142249; Jun. 1991.

*Primary Examiner*—N. Le
*Assistant Examiner*—Thinh Nguyen
*Attorney, Agent, or Firm*—Oliff & Berridge, PLC

[57] ABSTRACT

A multicolor printing device that synthesizes a substitute color by mixing color materials to perform a printing operation with no interruption due to the reduction of the specific color material. The device judges whether the specific color material remains. If no black color material remains, the device judges whether the substitute color is to be produced. If the production of the substitute color is set, density information of the black color material is converted to density information of the three colors. Furthermore, if the residual quantity of the specific color material is below a predetermined value and if the production of the substitute color is set, density conversion of the color materials is likewise performed.

31 Claims, 8 Drawing Sheets

MULTICOLOR PRINTING DEVICE

BACKGROUND OF THE INVENTION

1. Field of the Invention

The present invention relates to a multicolor printing device for performing color printing based on data that is prepared by a computer or the like.

2. Description of Related Art

Conventional multicolor printing devices include a vessel in which plural color materials having different colors are stocked. When a specific color material is consumed or becomes insufficient (i.e., its residual quantity becomes small), a printing operation is interrupted and a message display is made with a lamp or a panel to warn the user of an abnormality. Based on this alarm, the user replaces the insufficient or emptied color material in the vessel and continues the printing operation.

However, in this type of conventional device, the printing operation must be ceased if there is no spare color material. Furthermore, when solid color materials are used, the colored material must be melted as a pre-stage of the printing operation. Thus, there is a disadvantage that the printing operation must be ceased for approximately 30 minutes after the replacement of the color material. There has been developed a technique using liquid ink as the colored material. Primary color ink components are mixed with each other to obtain various colors. However, there is no consideration to continue the printing operation when a specific color material is emptied. See Japanese Laid-Open Patent Publication No. 3-142249, the subject matter of which is incorporated herein by reference.

SUMMARY OF THE INVENTION

An object of the present invention is to provide a multicolor printing device that mixes color materials with one another on a recording medium to perform a printing operation with no interruption even when a specific color material is emptied.

Another object of the present invention is to provide a multicolor printing device in which even when a specific color material becomes insufficient, plural color materials are mixed with the insufficient specific color material to complement the insufficient specific color material with the other color materials. This can prevent reduction of the specific color material and its use can be extended.

According to the present invention, a multicolor printing device includes plural vessels filled with plural color materials having primary colors and specific colors. A color material jetting device jets each of the color materials filled in the plural vessels onto a recording medium in which plural color materials are mixed with one another to represent multicolor images. A color material volume detection device detects when the volume of each color material is reduced to zero (i.e., the color material is emptied). A substitute color producing device produces a substitute color with color materials other than a specific color material when the empty condition of the specific color material is detected by the color material volume detection device.

The multicolor printing device may further include a setting device that determines when the production of the substitute color is performed by the substitute color producing device.

Further, a multicolor printing device may include plural vessels filled with plural color materials such as primary colors and specific colors. A color material jetting device jets each of the color materials filled in the plural vessels onto a recording medium. Plural color materials are mixed with one another on the recording medium to represent multicolor images. A residual quantity detection device detects whether a residual quantity of the specific color material is reduced to at least a predetermined value. A substitute color producing devices mixes the specific color material and plural color materials (other than the specific color material) to produce the substitute color when the residual detection device detects that the residual quantity of the specific color material is below the predetermined value.

Each of the color materials filled in the plural vessels may be jetted onto the recording medium by the color material jetting device and mixed with one another to represent multicolor images. In this multicolor printing operation, when the color material volume detecting device detects that the volume of a specific color material filled in a vessel is reduced to zero, a substitute color for the specific color material is produced by the substitute color producing device with color materials other than the specific color material. Therefore, the printing operation can continue even when the specific color material is empty.

The setting device enables an user to determine whether the substitute color is produced with the substitute color producing device.

Further, when the residual quantity detection device detects that the residual quantity of a specific color material is reduced to a predetermined value, the specific color material and plural color materials other than the specific color material are mixed with one another by the substitute color producing device to produce the substitute color. With this operation, the specific color of the specific color material can be complemented with color materials other than the specific color material. Thus, the use of the specific color material can be extended.

Still further, even when the volume of the specific color material is reduced to zero, the substitute color can be produced with color materials other than the specific color so that the printing operation can continue even when the specific color material is emptied. Further, in a multicolor printing operation having characters and figures that are mixed with one another, a substitute color can be synthesized for a color material (such as black color material) that tends to be more frequently used than the other primary color materials. Thus, the consumption amount of the color materials can be made to be approximately equal to one another.

In addition, it can be determined whether production of a substitute color should be performed.

Even still further, the specific color material and plural other color materials can be mixed with one another to produce the substitute color when the residual quantity of the specific color material is below a predetermined value. Therefore, the substitute color can be made to approximate the color of the specific color material more so than when the substitute color is produced with only the color materials other than the specific color material. Thus, the consumption amount of the specific color material may be suppressed to extend its use.

Other objects, advantages and salient features of the invention will become apparent from the detailed description taken in conjunction with the annexed drawings, which disclose preferred embodiments of the invention.

BRIEF DESCRIPTION OF THE DRAWINGS

A preferred embodiment of the present invention will be described in detail with reference to the following drawings wherein like reference numerals refer to like elements and wherein.

DETAILED DESCRIPTION OF PREFERRED EMBODIMENTS

Preferred embodiments of a multicolor printing device according to the present invention will be described hereafter with reference to the accompanying drawings.

Figure 1:
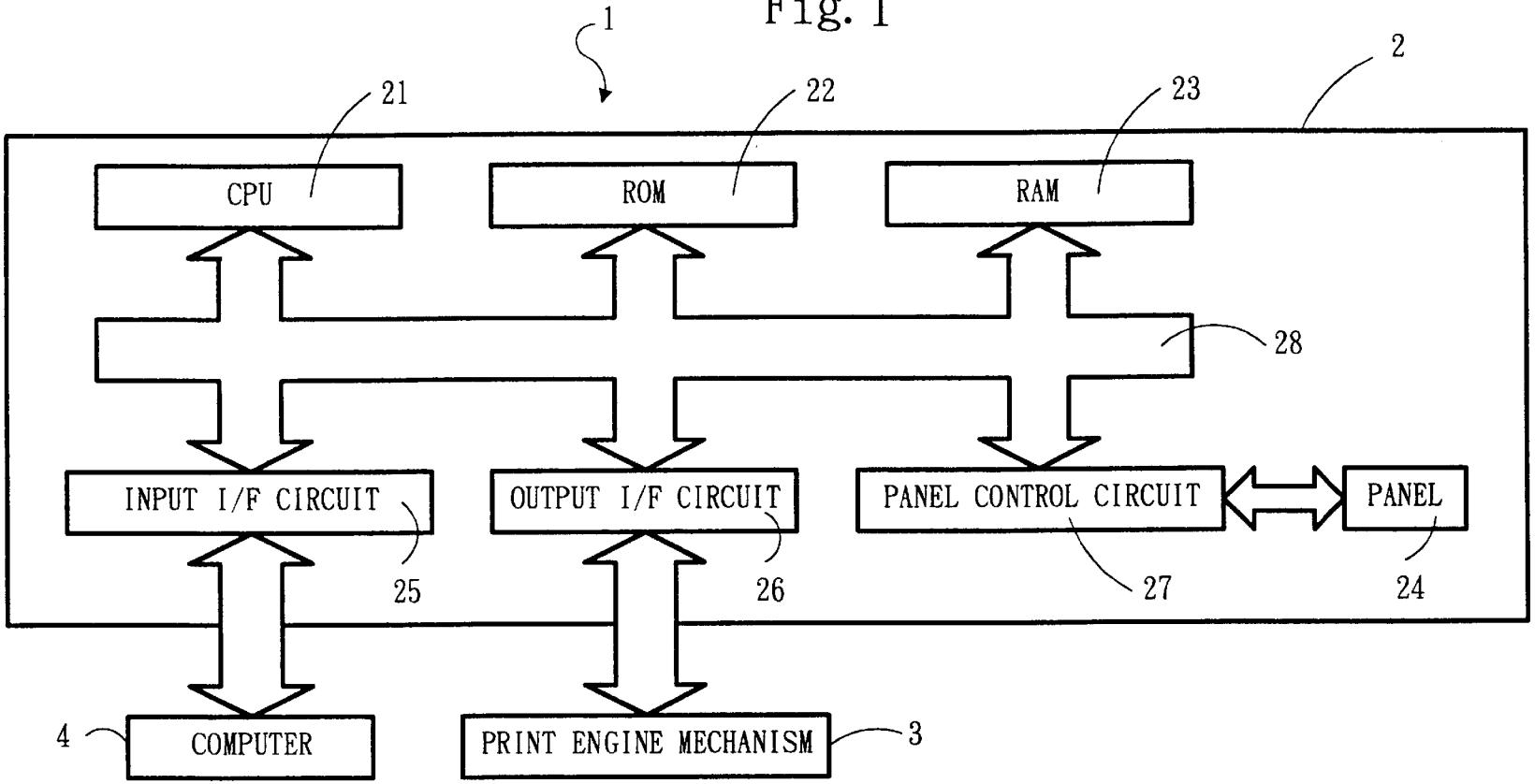
FIG. 1 is a block diagram showing a multicolor printing device of an embodiment of the present invention.

FIG. 1 is a block diagram showing the construction of a multicolor printing device or printer. In this embodiment, three color components of cyan, magenta and yellow are used as primary color components and black is used as the specific color. The color components may be either solid ink or liquid ink. The multicolor printing device 1 includes a print controller 2 and a print engine mechanism 3. The print controller 2 is connected to a computer 4. The print controller 2 includes a CPU 21 for controlling operation of the controller 2, a ROM 22 storing programs, a RAM 23 storing data, a panel 24 for inputting operation instructions, an input I/F circuit 25 for inputting data from the computer 4, an output I/F circuit 26 for outputting to the print engine mechanism 3 and a panel control circuit 27. These feature are connected to one another through an internal bus 28 so that data is exchangeable.

Figure 2:
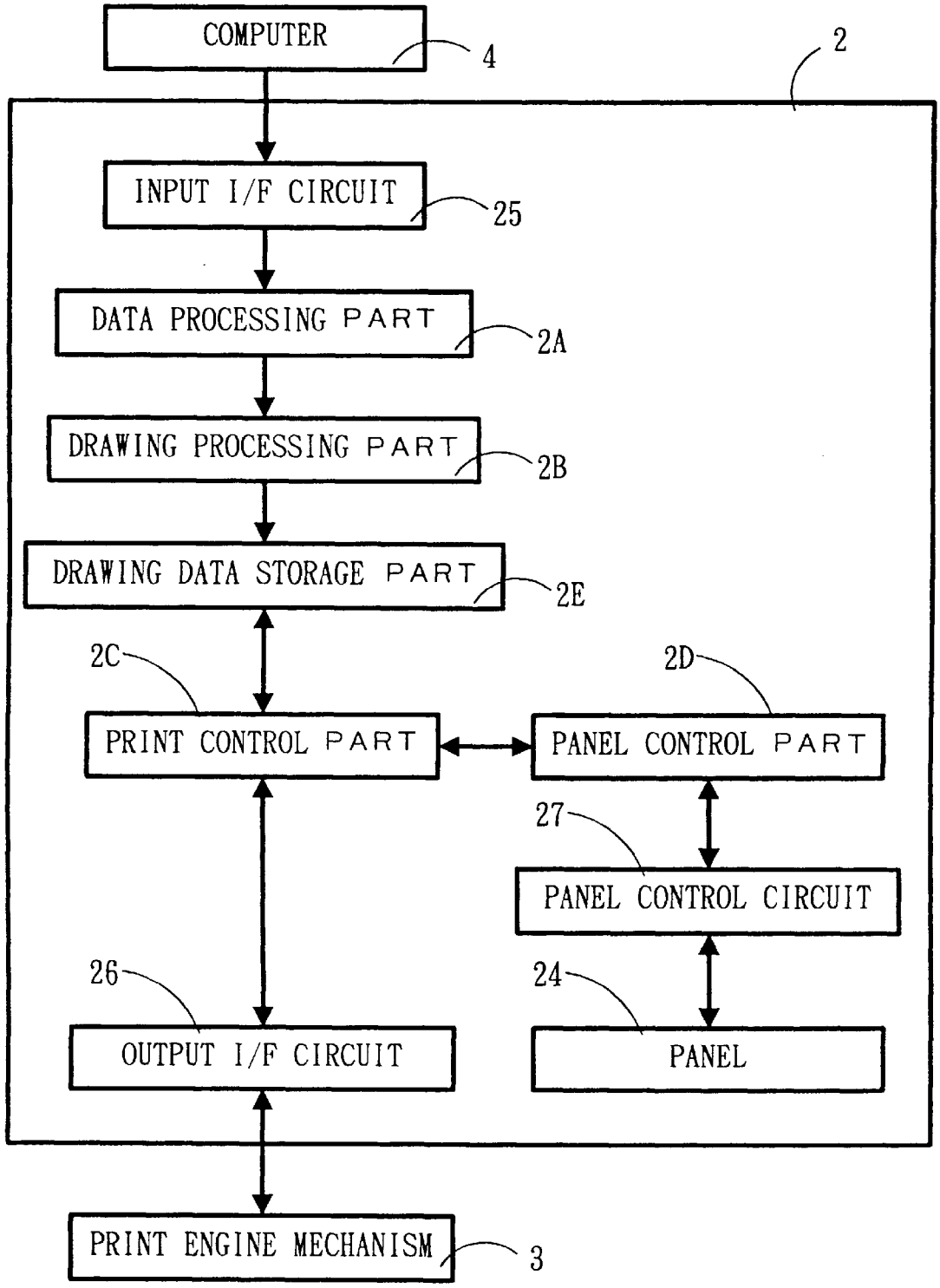
FIG. 2 is a block diagram showing parts executed by a CPU of the multicolor printing device and a circuit diagram relating thereto.

FIG. 2 is a block diagram showing parts executed by the CPU 21 according to the programs stored in the ROM 22. The parts executed by the CPU 21 include a data processing part 2A, a drawing processing part 2B, a print control part 2C and a panel control part 2D. A drawing data storage part 2E is included within the RAM 23 together with a work memory (not shown). Print data is transmitted from the computer 4 to the data processing part 2A where a justice check and analysis of the transmitted print data is performed. The print that is analyzed and recognized as figures by the data processing part 2A is then converted to a data format suitable for printing such as bit map data by the drawing processing part 2B. This data format is then stored in the drawing data storage part 2E. When a predetermined amount of data to be drawn is stored, the print control part 2C instructs the print engine mechanism 3 to feed the recording medium to subsequently start the printing operation. The predetermined amount of data to be drawn is set to an amount suitable for the drawing (e.g., a data amount corresponding to one page). When the recording medium arrives at a predetermined position, the print engine mechanism 3 notifies the print control part 2C of the arrival of the recording medium. In response to this notification, the print control part 2C instructs the drawing data storage part 2C to transmit the data to the print engine mechanism 3.

Figure 3:
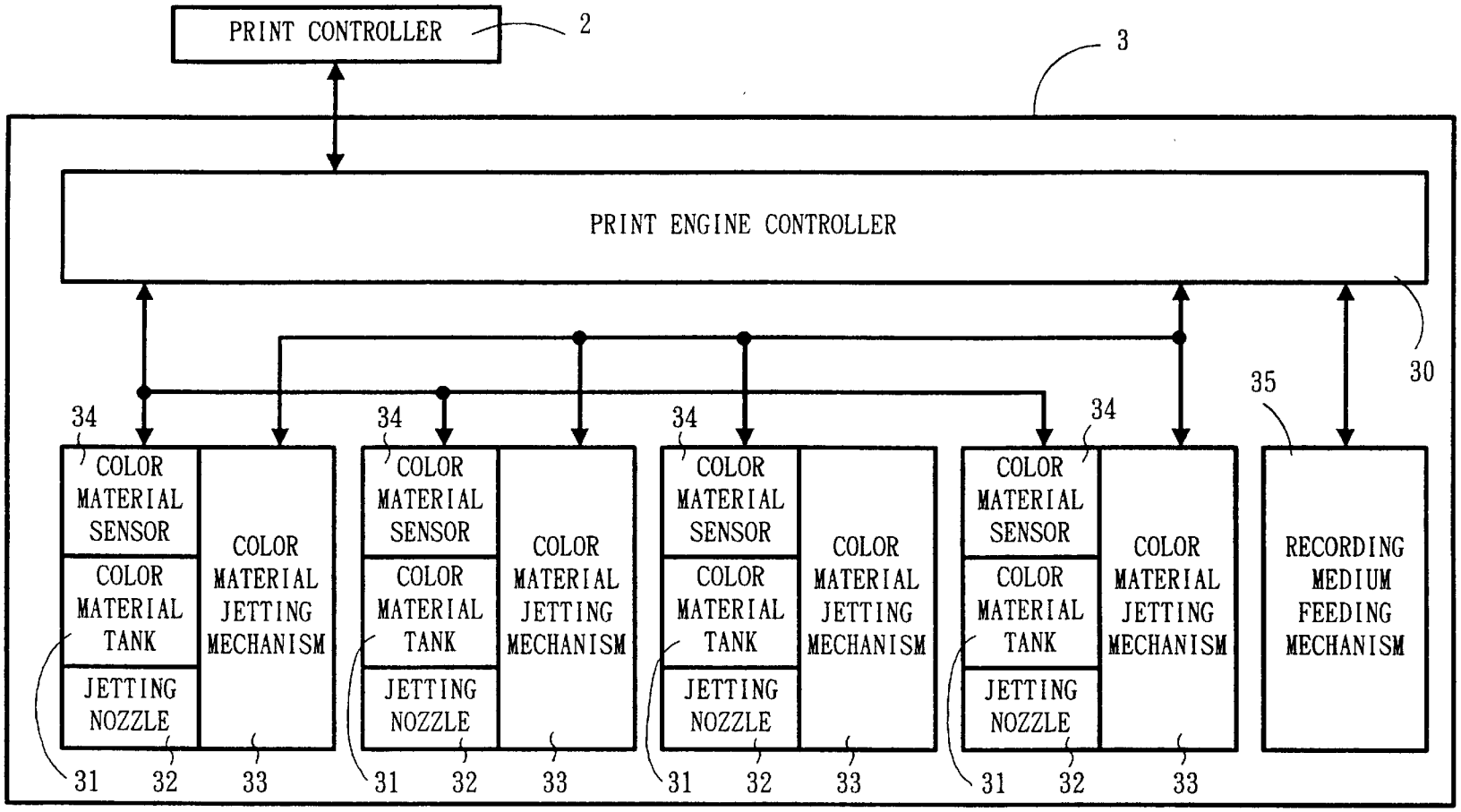
FIG. 3 is a block diagram showing the construction of a print engine mechanism.

FIG. 3 is a diagram showing one example of a construction of the print engine mechanism 3. The print engine mechanism 3 includes a print engine controller 30, color-material tanks 31 for four colors, color material jetting nozzles 32 for the respective four colors, color material jetting mechanisms 33, color material sensors 34 and a recording medium feeding mechanism 35 for feeding sheets.

According to the instructions from the print controller 2, the print engine controller 30 instructs the recording medium feeding mechanism 35 to feed the recording medium to a predetermined position. The print engine controller 30 also supplies the color material jetting mechanisms 33 with control information such as the density of the color to be printed. In response to the control information, the color material jetting mechanisms 33 jet the color materials filled in the respective color material tanks 31 onto the recording medium. The color material jetting mechanisms are preferably color ink jetting heads. Furthermore, in response to an instruction from the print engine controller 30, the color material sensors 34 output information relating to the residual quantity of the respective color materials filled in the color material tanks 31 to the print engine controller 30. The residual quantity information is further transmitted to the print controller 2 and is then used as control information to produce the substitute color.

Figure 4:
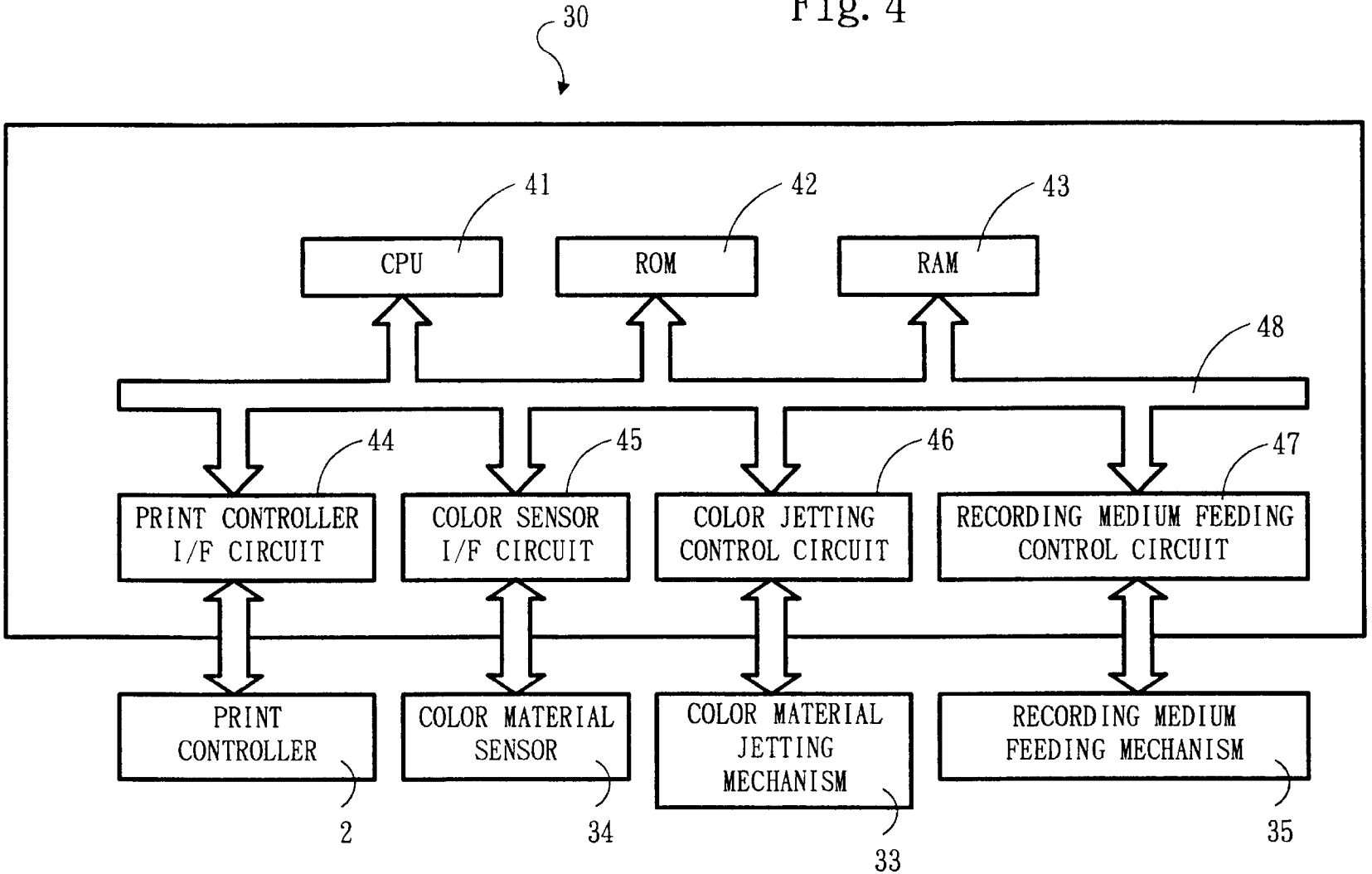
FIG. 4 is a block diagram showing the construction of a print engine controller.

FIG. 4 is a block diagram showing one example construction of the print engine controller 30. A CPU 41 controls operation of the print engine mechanism, a ROM 42 contains programs for the print engine control, and a RAM 43 includes a buffer for temporarily storing information from the sensors and the instructions from the print controller 2. The CPU 41, the ROM 42, the RAM 43, a print controller I/F circuit 44, a color sensor I/F circuit 45, a color jetting control circuit 46 and a recording medium feeding control circuit 47 are connected to one another by an internal bus 48 to exchange data. The print controller 2 is connected to the print controller I/F circuit 44. Each color material sensor 34 is connected to the color material sensor I/F circuit 45. Each color material jetting mechanism 33 is connected to the color jetting control circuit 46. Further, the recording medium feeding mechanism 35 is connected to the recording medium feeding control circuit 47.

Operation of the multicolor printing device 1 will now be described. The color representation basically varies based on the amounts of the respective primary color materials. When different color materials are deposited at the same point or adjacent points on the recording medium, a color mixture occurs based on the amount of each deposited color material or the number of points of each deposited color material so that the deposited color materials are visually recognized as various colors. In such a situation that all color materials are filled in the respective color material tanks 31, print data is output as density information of each color from the print controller 2 and is then transmitted to the color material jetting mechanisms 33 by the print engine controller 30 to vary the jet amount of each color material to the recording medium.

Each color material sensor 34 transmits the residual quantity of the color material to the print engine controller 30 at a fixed time interval (e.g., before the start of the print operation of one line) so that the print engine controller 30 can judge the residual quantities. In principle, a multicolor image can be represented by mixing primary color components. However, the primary color components may contain undesired color components. Thus, it is difficult to accurately reproduce desired colors when these color materials are mixed with one another. Therefore, a specific color material is used for a color that is most frequently used.

Figure 5:
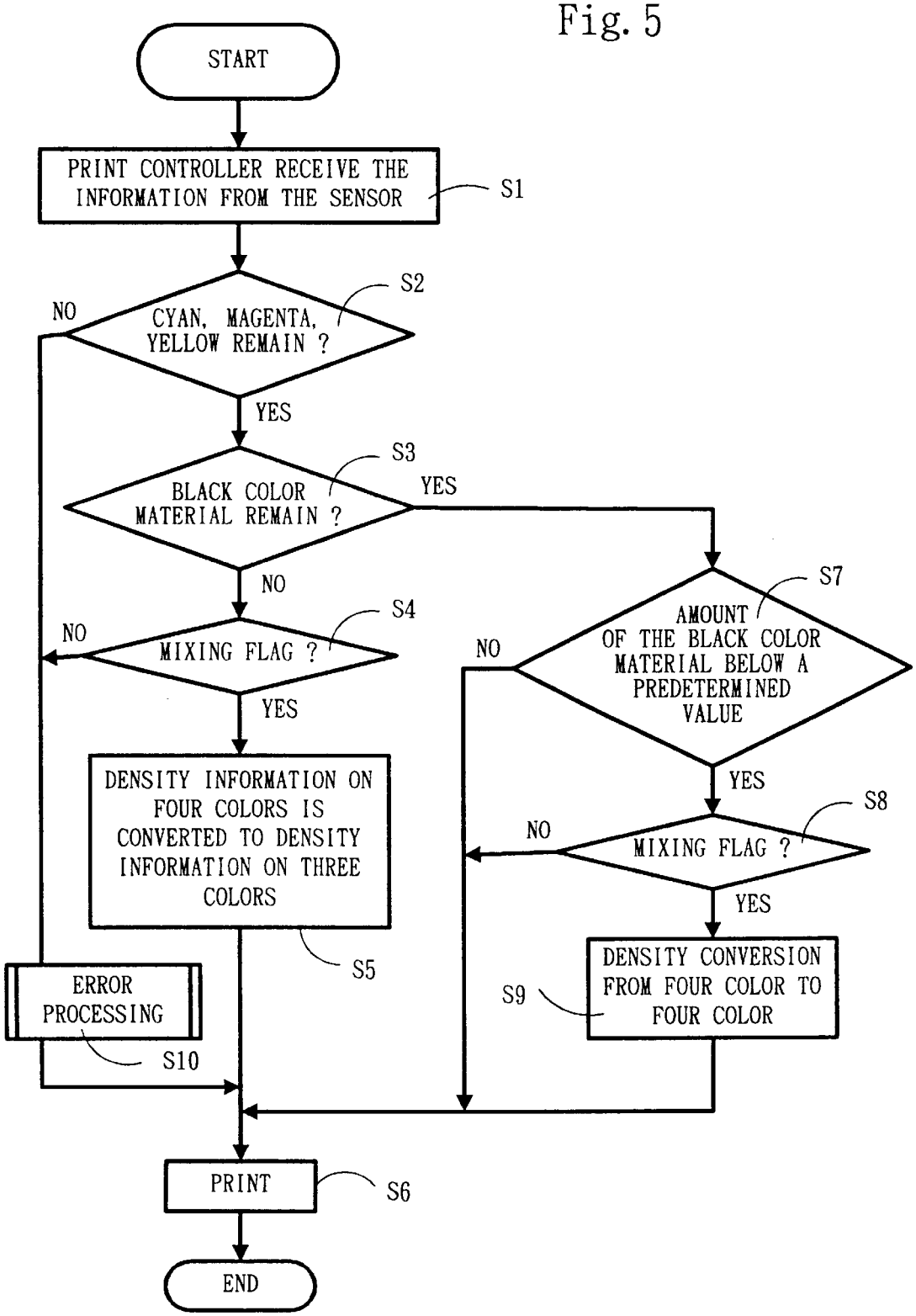
FIG. 5 is a flowchart showing processing for residual quantity judgment of color materials and production of a substitute color.

FIG. 5 is a flowchart for processing the print control part 2C of the print controller when a specific color material is empty or reduced to at least a predetermined value. As described above, the color material sensor 34 informs the print engine controller 30 of the residual quantity of the color material at a fixed time interval. The information from the sensor 34 is transmitted through the output I/F circuit 26 to the print control part 2C in step S1. Based on the transmitted information, it is judged whether the three primary colors of cyan, magenta and yellow remain in step S2. If the judgment in step S2 is "No", process branches to an error processing step S10. If the judgment in step S2 is "Yes", it is then judged whether a specific color material (i.e., black color material) remains in step S3.

If no black color material remains, a color mixing flag (described below) that is set based on the user's judgment whether substitute color should be produced is checked in step S4. When the color mixing flag represents "YES", the density information on the four colors is converted to density information of the three colors (except for the black color) in step S5. When black is specified as the specific color, the density conversion described above is performed by suitably dividing the density information of the black based on the ink characteristics of cyan, magenta and yellow and then adding the density of each of the three color components of cyan, magenta and yellow.

For example, a value that is equal to ⅓ of the density information of the black may be added to the density of each of the three color components of cyan, magenta and yellow. When the value that is equal to ⅓ of the density information of the black is added to the density of each of the three color components of cyan, magenta and yellow, the produced substitute black may be tinged with red. In this case, the rate of cyan may be increased. Furthermore, when the produced substitute color (black) is light, 40% of the density information of the black may be added to the density of each of the three color components of cyan, magenta and yellow. The density of each of the three color components of cyan, magenta and yellow is then added or subtracted based on the ink characteristics. Thus, the mixing rate is not necessarily set to a fixed value.

The specific color is not limited to black and thus the rate of the conversion may be varied based on the specific color. For example, when the specific color is green, the density that is half of the density of green is added to each of the two color components of cyan and yellow. After the density conversion, the print engine controller 30 is instructed to perform the print operation in step S6.

When the black color material remains in step S3, it is judged whether the amount of the black color material is below a predetermined value in step S7. If it is below the predetermined value, the state of the mixing flag is determined (like in step S4) in step S8. If the mixing flag is "YES", density conversion from four colors to four colors is in step S9. In this density conversion, the density of black is set to a quarter of the required amount based on the drawing data. Each of the three color components of cyan, magenta and yellow is also added with a quarter of the desired black amount.

When black color is produced by mixing only the three color components of cyan, magenta and yellow, the produced black color is not true black; rather, it is tinged with brown or it is inclined to a specific color. However, the addition of black to the three color components brings such an effect that the inclination of the produced black to the specific color can be suppressed and the consumption of the black color material can be reduced.

If the black color material is determined to not be below the predetermined value in step S7 or if the color mixing flag is determined to be "NO" in step S8, the process goes to step S6 to perform normal print processing.

Figure 6:
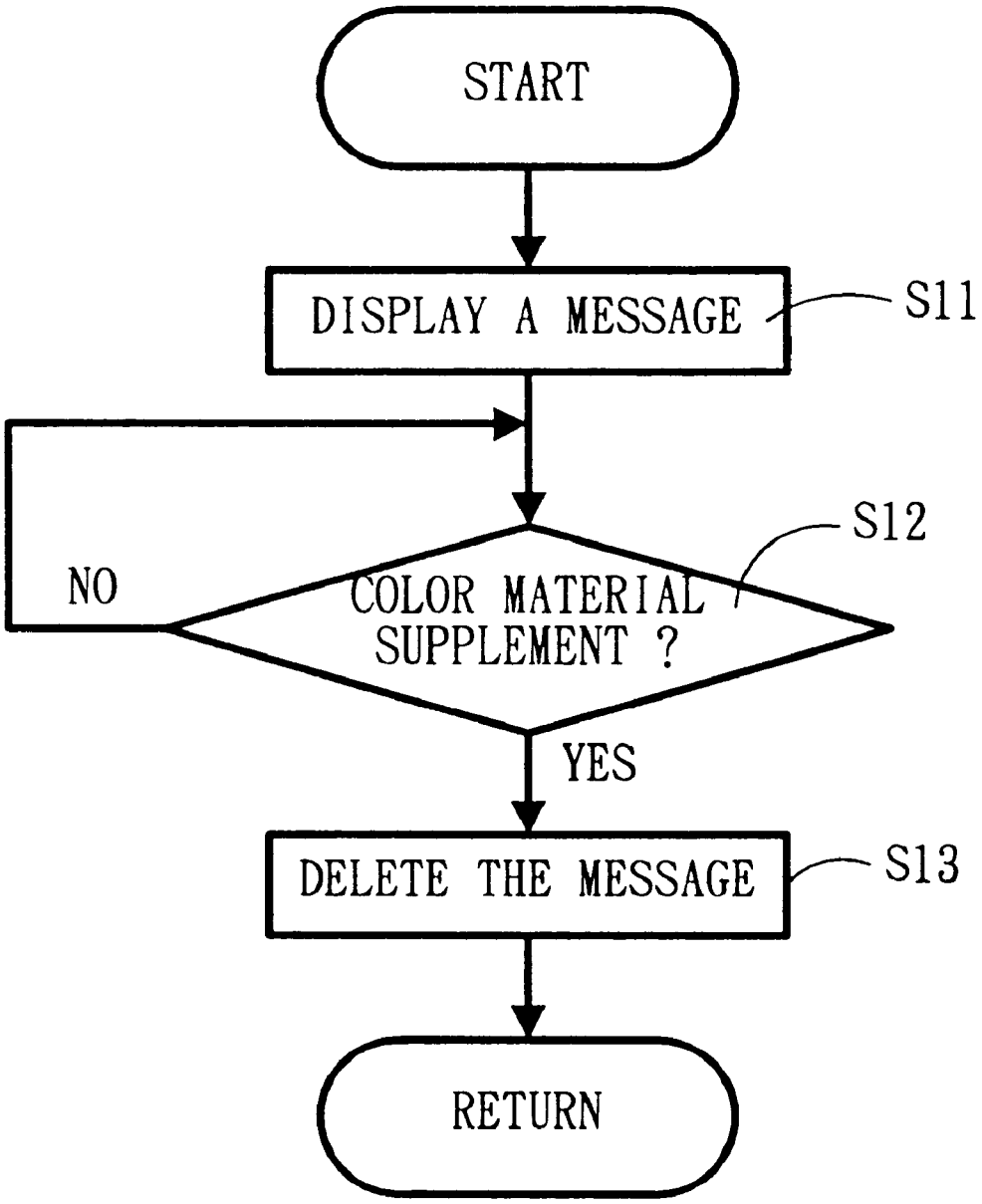
FIG. 6 is a flowchart showing error processing when a color material is empty.

FIG. 6 is a flowchart for the error processing of step S10. In the error processing, a message showing a lack of a color material is instructed by the print control part 2C to be displayed in step S11 on the panel control part 2D as a message for promoting supplement of the color material. Subsequently, in step S12 it is judged whether an user supplements the color material based on the information from the color material sensor 34. The judgment process is continued in a loop mode until the color material is supplemented. After the supplement of the color material is confirmed, the message on the panel 24 is deleted step S13 and the process goes to the print processing of step S6 in FIG. 5.

Figure 7:
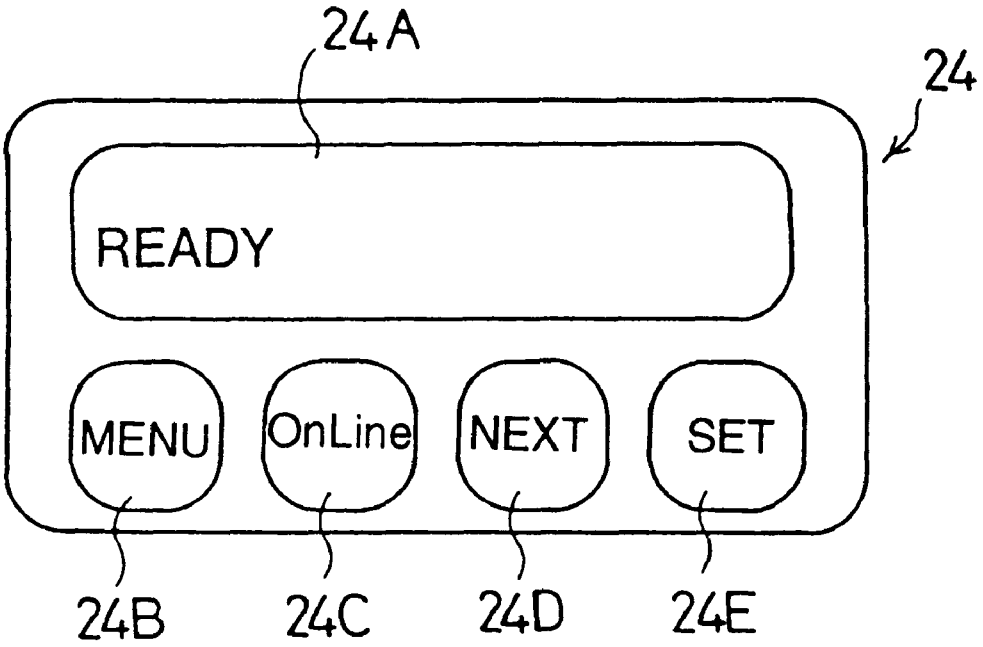
FIG. 7 is a diagram showing the construction of a panel.

FIG. 7 shows the one example construction of the panel 24. The signal processing from the print control part 2C to the panel 24 will be described with reference to FIGS. 1, 2 and 7.

The panel 24 is provided with a panel display unit 24A using a liquid crystal display to display a message for a user, a menu button 24B, an on-line button 24C, a next button 24D and a set button 24E provided for the user's input of instructions to the print controller 2. The panel 24 is connected to a panel control part 2D through the panel control circuit 27. The panel control part 2D transmits message data to be displayed on the panel 24 and identifies the buttons that are pushed on the panel 24. The identified buttons are reflected to a flag that is managed by the print control part 2C.

The print control part 2C is provided with the color mixing flag representing whether the substitute color should be produced. Based on the state of the color mixing flag, the print control part 2C judges whether a substitute color should be produced when a specific color material is emptied.

Figure 8:
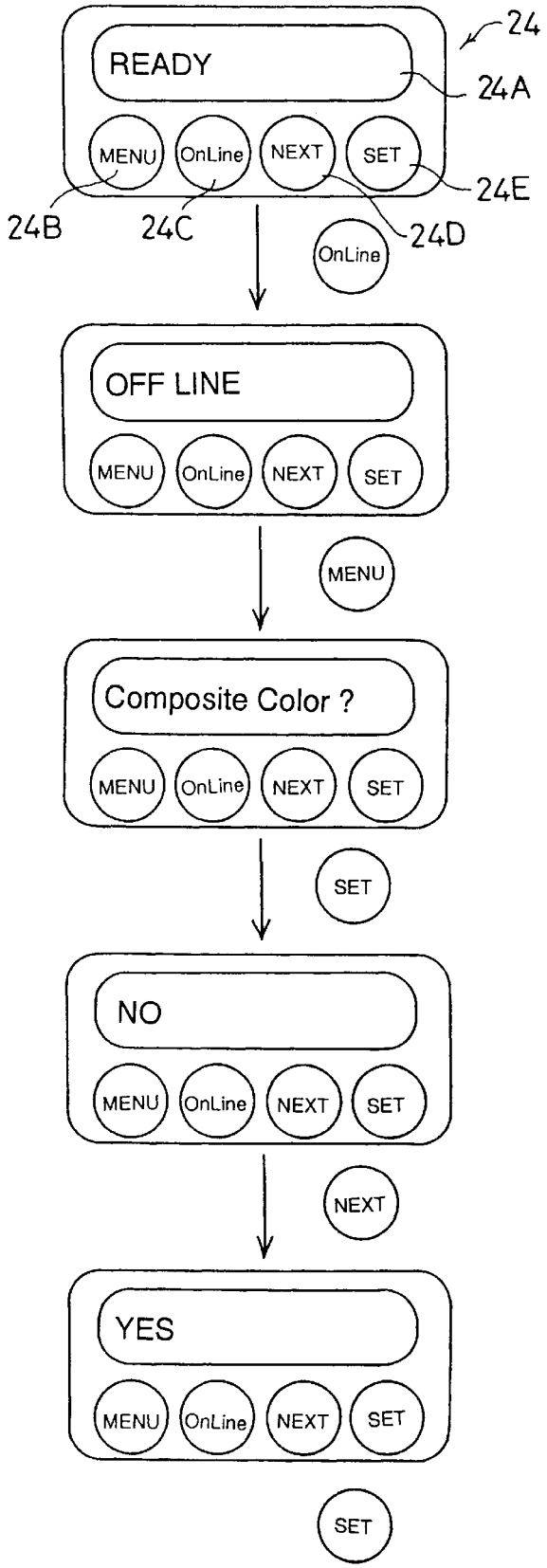
FIG. 8 is a diagram showing an operation procedure for indicating the production of the substitute color on the panel.

FIG. 8 is a process flow of a setting procedure to determine whether a substitute color should be produced by manipulation of the menu button 24B, the on-line button 24C, the next button 24D and the set button 24E. "READY" is initially displayed on the panel display unit 24A during operation of the multicolor printing device 1. The display changes to "OFF LINE" when the on-line button 24C is pushed. Subsequently, the display changes to "Composite Color ?" when the menu button 24B is pushed. Upon pushing the set button 24E, the user instructs the production of the substitute color. At first, the display is "NO". The display is changed to "YES" by pushing the next button 24D. At this time, when the set button 24E is pushed, the color mixing flag is set to "YES". This setting procedure may be performed not only by the user's input operation on the panel but also by the computer 2. In this case, various commands containing a command of instructing "YES" or "NO" of the color mixing flag to the print data are analyzed by the data processing part 2A and the content of the command is immediately set to the color mixing flag.

Thus, even when the black color material is empty, a substitute color for the black can be produced using color materials other than black. Therefore, printing operation can be performed without being interrupted when the black color is empty. Particularly, in a multicolor printing operation containing characters and figures mixed with one another, black color is more frequently used than the other primary color materials. Thus, black color tends to be consumed earlier than the other color materials. However, by synthesizing a substitute color for the black color as described above, the consumption rate of the color materials can be made approximately equal to one another.

Furthermore, when the residual quantity of the black color is below a predetermined value, the black color material and other color materials may be mixed with one another to produce the substitute black color. Therefore, the produced black color can be made to more approximate true black as compared when black is produced with color materials excluding the black color material.

Other modifications are also within the scope of this invention. For example, in the embodiment as described above, the four colors of cyan, magenta, yellow and black are used. However, colors other than black may be used as the specific color in place of or in addition to black. For example, when the specific color is green, green can be synthesized using cyan and yellow. When the specific color is blue, blue can be synthesized using cyan and magenta. Further, when the specific color is red, red can be synthesized using magenta and yellow.

While the invention has been described in relation to preferred embodiments, many modifications and variations are intended to be within the scope of the present invention as defined in the appended claims.

What is claimed is:

1. A multicolor printing device having a plurality of vessels each filled with one of a plurality of color materials and a color material jetting device that jets the color materials from corresponding vessels onto a recording medium, the printing device comprising:

color material volume detection means for sensing a volume of one color material in one of said plurality of vessels and providing a detected output when a volume of said one color material is reduced to at least one predetermined volume, said at least one predetermined volume including a volume greater than a zero volume; and a substitute color producing means for producing a substitute color upon receipt of the detected output, wherein the substitute color producing means produces the substitute color using the one color material and at least one of the color materials other than the one color material.

2. The multicolor printing device of claim 1, further comprising setting means for setting whether said substitute color producing means should produce the substitute color.

3. The multicolor printing device of claim 2, further comprising a display device to display a setting of the setting means.

4. The multicolor printing device of claim 1, wherein said at least one predetermined volume further including a volume that is substantially zero.

5. The multicolor printing device of claim 1, further comprising conversion means for converting density information on four colors to density information on three colors.

6. The multicolor printing device of claim 1, wherein the substitute color is produced by mixing at least two of the color materials on the recording medium.

7. The multicolor printing device of claim 1, wherein the substitute color producing means includes a density setting device that varies a density of each of the color materials based on a density of the color material.

8. The multicolor printing device of claim 1, further comprising error correction means for displaying a correction indication until one of color materials is supplemented.

9. The multicolor printing device of claim 8, wherein the correction indication is a message.

10. The multicolor printing device of claim 1, further comprising error correction means for displaying a correction indication until one of the color materials is supplemented.

11. The multicolor printing device of claim 10, wherein the correction indication is a message.

12. The multicolor printing device of claim 11, wherein the color material jetting device includes a color ink jetting head.

13. The multicolor printing device of claim 12, further comprising an equal consumption means for controlling the substitute color producing means to produce the substitute color such that a specific color and at least one other color material are used for printing at equal rates.

14. A multicolor printing device for producing multicolor images on a recording medium, the multicolor printing device comprising:

a plurality of vessels storing a plurality of color materials;

a plurality of sensors, each sensor sensing a quantity of color material within a corresponding vessel and providing a detected output; and a substitute color producing device that produces a substitute color for a low-quantity color material upon receipt of the detected output when a corresponding sensor senses that a quantity of the low-quantity color material is at least one predetermined value, said at least one predetermined value including a predetermined value indicative of a quantity of the low-quantity color material being greater than zero, wherein the substitute color producing device produces the substitute color using the low-quantity color material and at least one other color material.

15. The multicolor printing device of claim 14, further comprising a setting device that sets whether said substitute color producing device produces the substitute color.

16. The multicolor printing device of claim 14, wherein said at least one predetermined value further including a predetermined value indicative of a quantity of the low-quantity color material being substantially zero.

17. The multicolor printing device of claim 14, further comprising a conversion device that converts density information on four colors to density information on three colors.

18. The multicolor printing device of claim 14, wherein the substitute color is produced by mixing the plurality of color materials on the recording medium.

19. The multicolor printing device of claim 14, further comprising an error correction device that displays a correction indication until one of the color materials is supplemented.

20. The multicolor printing device of claim 19, wherein the correction indication is a message.

21. The multicolor printing device of claim 14, further comprising an error correction device that displays a correction indication until one of the color materials is supplemented.

22. The multicolor printing device of claim 21, wherein the correction indication is a message.

23. A method of producing a multicolor image on a recording medium using a multicolor printing device having a plurality of vessels storing a plurality of color materials and a plurality of sensors each for sensing a quantity of color material in a corresponding vessel and providing a detected output, the method comprising the steps of:

detecting a quantity of a color material and providing said detected output; and producing a substitute color for the color material upon receipt of the detected output when the detecting step detects that the quantity of a specific color material is reduced to at least one predetermined value, said at least one predetermined value including a value indicative of a quantity of the specific color material being greater than zero, wherein the producing step produces the substitute color using the specific color material and at least one of the other color materials.

24. The method of claim 23, further comprising displaying a correction indication until one of the color materials is supplemented.

25. The method of claim 24, wherein the correction indication is a message.

26. The method of claim 23, wherein said at least one predetermined value further including a predetermined value indicative of a quantity of the specific color material being substantially zero.

27. The method of claim 23, further comprising the step of converting density information on four colors to density information on three colors.

28. The method of claim 23, wherein the producing step comprises producing the substitute color by mixing at least two of the plurality of color materials.

29. The method of claim 23, further including providing a setting device that sets whether said substitute color is produced.

30. The method of claim 23, further comprising displaying a correction indication until one of the color materials is supplemented.

31. The method of claim 30, wherein the correction indication is a message.

* * * * *